US011060384B2

(12) United States Patent
Zhu et al.

(10) Patent No.: US 11,060,384 B2
(45) Date of Patent: Jul. 13, 2021

(54) METHOD FOR PRECISELY EXTRACTING COAL-MINE GAS

(71) Applicant: CHINA UNIVERSITY OF MINING AND TECHNOLOGY, Jiangsu (CN)

(72) Inventors: Chuanjie Zhu, Jiangsu (CN); Baiquan Lin, Jiangsu (CN); Zishan Gao, Jiangsu (CN); Ximiao Lu, Jiangsu (CN)

(73) Assignee: CHINA UNIVERSITY OF MINING AND TECHNOLOGY, Jiangsu (CN)

( * ) Notice: Subject to any disclaimer, the term of this patent is extended or adjusted under 35 U.S.C. 154(b) by 0 days.

(21) Appl. No.: 16/090,080

(22) PCT Filed: Dec. 4, 2017

(86) PCT No.: PCT/CN2017/114363
§ 371 (c)(1),
(2) Date: Sep. 28, 2018

(87) PCT Pub. No.: WO2018/201714
PCT Pub. Date: Nov. 8, 2018

(65) Prior Publication Data

US 2021/0040822 A1 Feb. 11, 2021

(30) Foreign Application Priority Data

May 2, 2017 (CN) ..... 201710301504.0

(51) Int. Cl.
*E21B 43/00* (2006.01)
*E21B 47/10* (2012.01)
(Continued)

(52) U.S. Cl.
CPC ..... *E21B 43/006* (2013.01); *E21B 7/04* (2013.01); *E21B 47/10* (2013.01); *E21B 49/00* (2013.01)

(58) Field of Classification Search
CPC ..... E21B 47/00; E21B 47/002; E21F 7/00
See application file for complete search history.

(56) References Cited

U.S. PATENT DOCUMENTS 3,933,447 A * 1/1976 Pasini, III ..... E21B 43/243 166/259
4,875,015 A * 10/1989 Ward ..... G01V 3/20 324/323
(Continued)

FOREIGN PATENT DOCUMENTS

CN 102508941 A 6/2012
CN 103184887 A 7/2013
(Continued)

*Primary Examiner* — Daniel P Stephenson
(74) *Attorney, Agent, or Firm* — Seed Intellectual Property Law Group LLP

(57) ABSTRACT

In a method, a gyroscope and an endoscopic camera are first used to investigate coal-seam strike trend, coal-seam dip trend, and coal-seam thickness data of a to-be-extracted area. According to gas extraction standard requirements of a to-be-extracted area, boreholes are then designed and constructed, and trajectories of boreholes are tracked to obtain a correspondence relationship between designed borehole parameters and actual borehole trajectory parameters. Next, drilling parameters are adjusted according to the correspondence relationship between the designed borehole parameters and the actual borehole parameters to construct boreholes at predetermined borehole locations. Subsequently, the boreholes are connected to an extraction pipeline, and gas extraction flow rates and gas extraction amounts per meter of the boreholes are observed. Eventually, other boreholes are designed and constructed according to the adjusted borehole construction parameters and extraction data. After being constructed, the boreholes are connected to perform gas extraction.

6 Claims, 3 Drawing Sheets

(51) Int. Cl.
*E21B 49/00* (2006.01)
*E21B 7/04* (2006.01)

(56) References Cited

U.S. PATENT DOCUMENTS

| | | | | | |
|---|---|---|---|---|---|
| 5,139,312 | A * | 8/1992 | Jackson | E21B 43/29 | 299/13 |
| 5,217,076 | A * | 6/1993 | Masek | E21B 43/24 | 166/245 |
| 8,813,840 | B2 * | 8/2014 | Zupanick | E21B 7/046 | 166/245 |
| 9,551,209 | B2 * | 1/2017 | Zupanick | E21B 41/0057 | |
| 2003/0079877 | A1 * | 5/2003 | Wellington | E21B 43/243 | 166/272.1 |
| 2003/0080604 | A1 * | 5/2003 | Vinegar | E21B 43/30 | 299/14 |
| 2003/0173072 | A1 * | 9/2003 | Vinegar | B09C 1/02 | 166/66.5 |
| 2007/0265782 | A1 * | 11/2007 | Kleinberg | G01V 3/083 | 702/6 |
| 2011/0119040 | A1 * | 5/2011 | McLennan | G06F 17/18 | 703/2 |

FOREIGN PATENT DOCUMENTS

| | | | | |
|---|---|---|---|---|
| CN | 103321629 | A | 9/2013 | |
| CN | 104899681 | A | 9/2015 | |
| CN | 107100663 | A | 8/2017 | |
| WO | 2011/000022 | A1 | 1/2011 | |
| WO | WO-2018201714 | A1 * | 11/2018 | E21B 47/00 |

* cited by examiner

METHOD FOR PRECISELY EXTRACTING COAL-MINE GAS

BACKGROUND

Technical Field

The present disclosure relates to a method for precisely extracting coal-mine gas, which is particularly applicable to precise and efficient extraction of gas in a gas-bearing coal seam of a coal mine, including accurate borehole positioning of a bottom hole point and accurate quantization of a gas extraction amount and residual gas content, so that gas extraction blanking zones caused by inappropriate extraction borehole design can be avoided.

Description of the Related Art

Borehole gas extraction is the major measure of gas control. Coal seams in China have relatively poor gas permeability, and ground drilling has a small influence range and a poor drainage effect. Therefore, small-diameter boreholes are usually constructed in coal mines to perform extraction. The construction of such boreholes is simple, and a quantity of the boreholes is relatively large. However, currently, an unsatisfactory extraction effect is achieved. One major cause is that coal seams are softer than other relatively hard rocks and have short distances. As a result, it is very difficult to control construction trajectories of boreholes. Both an actual coal length and a bottom hole point of a borehole are unclear. However, most of the existing designs are based on the assumption that a borehole is a straight-line borehole constructed from a drilling point, and an end point location of a borehole is not accurately positioned. Moreover, the trajectory of a borehole is not completely in a straight-line form. As a result, an amount of gas that can be extracted from each borehole is misjudged. In addition, coal seams in China have unstable occurrence and have greatly varying thicknesses. Previous designs are all based on the assumption that a coal seam has stable occurrence and even thickness and unvarying strike and dip angles. As a result, significantly different amounts of gas may be extracted from boreholes having the same design parameters. The foregoing causes lead to inaccurate calculation of an amount of gas extracted from each borehole, and gas extraction blanking zones are formed. During late-stage coal drift excavation, a gas overrun problem occurs easily, resulting in potential safety hazards and putting miners' lives at risk.

BRIEF SUMMARY

Embodiments of the present invention provide a method for precisely extracting coal-mine gas to resolve the problem of uneven time and space in gas extraction in coal seams and extraction blanking zones caused by unprecise design and construction of gas extraction boreholes in coal mines. By using methods of precisely positioning coal seam occurrence and precisely design gas boreholes, precise extraction of coal-mine gas is implemented, and the target precision of gas control is improved.

In accordance with an embodiment of the invention, a method for precisely extracting coal-mine gas includes:

(a) scanning a stratum profile of a to-be-extracted area of a coal seam;

(b) constructing stratum probe boreholes in the area of which the stratum profile is scanned;

(c) drawing a change trend graph of coal-seam strike, coal-seam dip, and coal-seam thickness in the to-be-extracted area;

(d) determining, according to coal-seam parameters of the to-be-extracted area and gas extraction standard requirements, a quantity of boreholes that need to be constructed and specific construction parameters of the boreholes;

(e) installing a drill at a location at which construction is to be performed, and mounting a gyroscope and an endoscopic camera inside a drill bit of the drill;

(f) performing construction in the coal seam by using the drill, tracking trajectories of a group of boreholes having various construction parameters, and recording borehole drilling point construction parameters and actual coal-point coordinates and hole-bottom coordinates;

(g) adjusting borehole drilling parameters according to a three-dimensional orientation relationship between the borehole drilling point construction parameters and actual borehole coal-point parameters;

(h) connecting the boreholes to an extraction pipeline, and mounting orifice meters to record gas extraction flow rates and the gas extraction flow rates per meter of different boreholes; and (i) designing and precisely constructing, according to the adjusted borehole construction parameters and the gas extraction flow rates per meter, other boreholes to predesigned borehole locations, sealing the boreholes after construction is completed, and performing gas extraction.

A stratum profiler is used to scan the stratum profile in step (a) in a roadway excavation direction with a construction location being a coal seam floor roadway.

The stratum probe boreholes in step (b) should be constructed to penetrate a coal bearing member, until cinder is no longer discharged.

For a method for drawing the change trend graph of coal-seam strike, coal-seam dip, and coal-seam thickness in the to-be-extracted area in step (c), a comprehensive determination method combining scan with a stratum profiler and borehole coordinate correction is used: first determining strike trend of a coal-bearing stratum by using the stratum profiler, and then delimiting an accurate boundary of the coal seam by using borehole coordinates.

For actual coal-seam floor coal-point coordinates and actual coal-seam roof coal-point coordinates in step (f), the endoscopic camera is used to record trajectory points respectively corresponding to borehole floor coal points and borehole roof coal end points, and specific coordinate values are then correspondingly determined from borehole trajectory points recorded by the gyroscope.

A method for adjusting the borehole construction parameters in step (g) is: first adjusting an azimuth angle, so that horizontal projections of a roof coal point of an actual borehole-trajectory and a designed roof coal point have the same length in a direction perpendicular to a roadway, and then adjusting a drilling location in a direction opposite to an offset direction according to an offset amount of a borehole in a roadway direction.

Beneficial effect: Because the foregoing technical solution is used, in some embodiments of the present invention, the method for precisely extracting coal-mine gas is implemented. Therefore, in one aspect, occurrence conditions of a coal seam and gas may be accurately obtained, and a gas extraction solution is precisely designed according to actual occurrence conditions of the coal seam and gas. In another aspect, construction parameters may be adjusted according to borehole trajectory features to accurately reach predesigned borehole locations, so as to avoid the problem of extraction blanking zones caused by inappropriate design of coal-mine gas extraction projects because engineers and technicians lack precise knowledge of occurrence variations of coal seams and gas. Moreover, actual borehole trajectories are tracked and positioned to avoid the problem of difficulty in positioning actual borehole trajectories and coal point locations, thereby implementing accurate assessment of gas extraction amounts and further determine residual gas content of a coal seam to provide a reference for gas control in later-stage mining or excavation in the coal seam.

Figure 1:
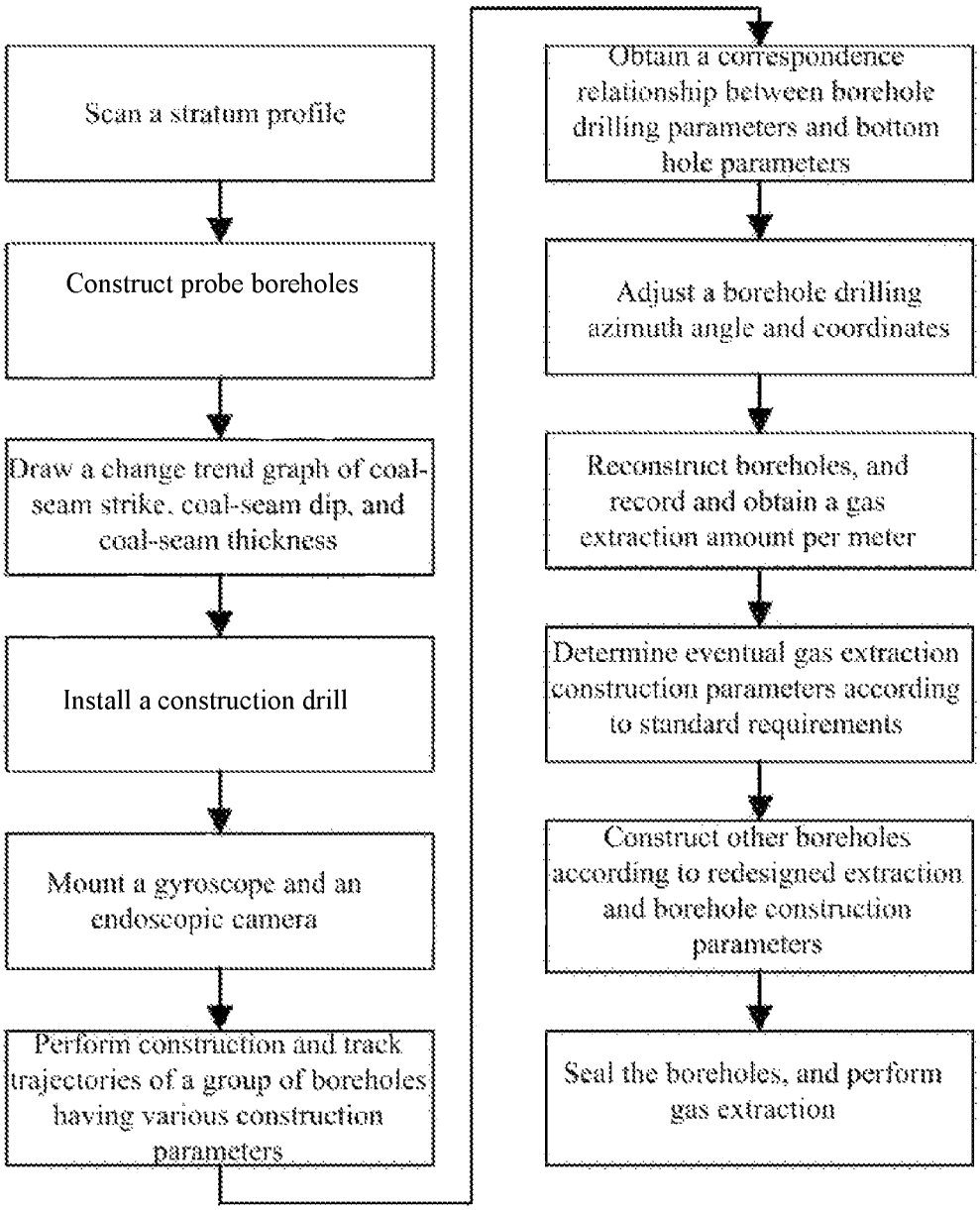
FIG. 1 is a schematic diagram of an implementation procedure according to some embodiments of the present invention.

In the drawings: 1-floor roadway; 2-coal-bearing stratum; 3-coal seam; 4-stratum probe borehole; 5-actual borehole floor coal point; 6-actual borehole roof coal end point; 7-coal-seam floor; 8-coal-seam roof; 901~907-actual construction borehole; 10-designed borehole; 11-designed borehole floor coal point; 12-designed borehole roof coal end point; 13-actual borehole azimuth angle; 14-rectified borehole azimuth angle; 15-designed borehole azimuth angle; 16-actual borehole trajectory horizontal projection; 17-designed borehole trajectory horizontal projection; and 18-rectified borehole trajectory horizontal projection.

DETAILED DESCRIPTION

As shown in FIG. 1, a method for precisely extracting coal-mine gas includes:

(a) scanning a stratum profile of a to-be-extracted area of a coal seam, where a stratum profiler is used to scan the stratum profile in a roadway excavation direction with a construction location being a coal seam floor roadway.

(b) constructing stratum probe boreholes in the area of which the stratum profile is scanned, where the stratum probe boreholes should be constructed to penetrate a coal bearing member, until cinder is no longer discharged;

(c) drawing a change trend graph of coal-seam strike, coal-seam dip, and coal-seam thickness in the to-be-extracted area, where for a method for drawing the change trend graph of coal-seam strike, coal-seam dip, and coal-seam thickness in the to-be-extracted area, a comprehensive determination method combining scan with a stratum profiler and borehole coordinate correction is used: first determining strike trend of a coal-bearing stratum by using the stratum profiler, and then delimiting an accurate boundary of the coal seam by using borehole coordinates;

(d) determining, according to coal-seam parameters of the to-be-extracted area and gas extraction standard requirements, a quantity of boreholes that need to be constructed and specific construction parameters of the boreholes;

(e) installing a drill at a location at which construction is to be performed, and mounting a gyroscope and an endoscopic camera inside a drill bit of the drill;

(f) performing construction in the coal seam by using the drill, tracking trajectories of a group of boreholes having various construction parameters, and recording borehole drilling point construction parameters and actual coal-point coordinates and hole-bottom coordinates of the boreholes, that is, recording actual borehole azimuth angles, tilt angles, coal-point coordinates in a coal-seam floor and a coal-seam roof, and a hole length, where the actual coal-point coordinates and hole-bottom coordinates are determined by using a method combining the gyroscope and the endoscopic camera, that is, the endoscopic camera records trajectory points respectively corresponding to borehole coal points and hole bottoms, and coordinate values at borehole trajectory points recorded by the gyroscope are then correspondingly determined;

(g) connecting the boreholes to an extraction pipeline, and mounting orifice meters to record gas extraction flow rates and the gas extraction flow rates per meter of different boreholes;

(h) adjusting borehole drilling parameters according to a three-dimensional orientation relationship between the borehole drilling point construction parameters and actual borehole coal-point parameters; a method for adjusting the borehole construction parameters in step (h) is: first adjusting an azimuth angle, so that horizontal projections of a roof coal point of an actual borehole-trajectory and a designed roof coal point have the same length in a direction perpendicular to a roadway, and then adjusting drilling point coordinates in a direction opposite to an offset direction according to an offset amount in a roadway direction; and (i) precisely constructing, according to the adjusted borehole construction parameters, boreholes to predesigned borehole locations, sealing the boreholes after construction is completed, and performing gas extraction.

Aspects of the present invention are further described below with reference to the illustrated embodiments in the accompanying drawings.

The gas content in a coal seam of a coal mine is 12 $m^3/t$. A geographically explored coal-seam thickness is 4 m. A floor roadway is constructed below a coal seam. The floor roadway has a length of 1 km. A perpendicular distance of the floor roadway from the coal seam is 10 m. A cross borehole is constructed in the floor roadway to pre-extract coal-seam gas to reduce the gas content in a pre-extraction area to be less than 8 $m^3/t$. The length and the width of the pre-extraction area are required to be 30 m and 4 m respectively. The coal density is 1.2 $t/m^3$. In this case, the coal reserve that can be effectively control has a total of 576 tons. Seven boreholes are first designed originally. 2304 $m^3$ of gas can be extracted through pre-extraction for six months, so that the residual gas content can be less than 8 $m^3/t$.

Figure 2:
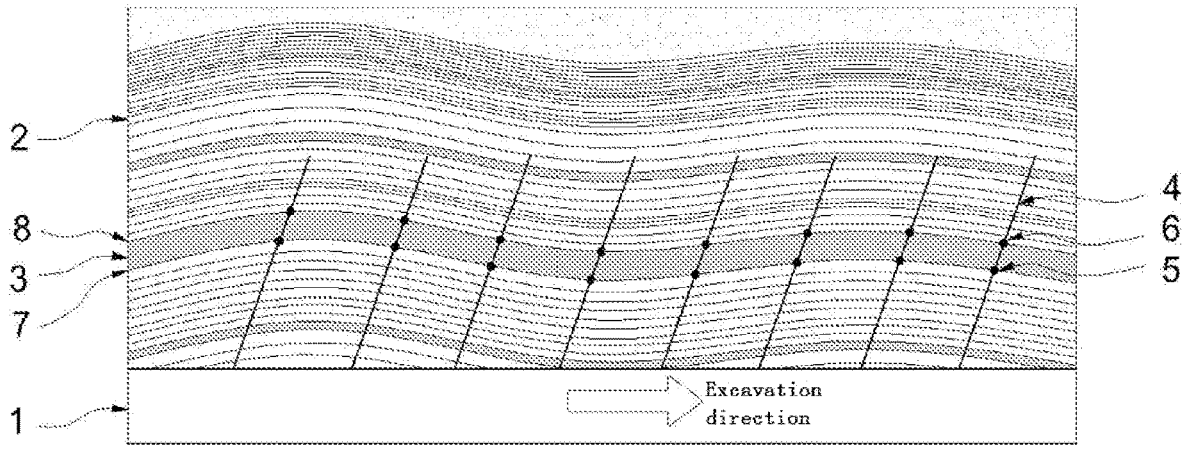
FIG. 2 is a schematic view of a method for investigating change trend of coal-seam strike, coal-seam dip, and coal-seam thickness according to some embodiments of the present invention.

As shown in FIG. 2, first, in a floor roadway 1 of a coal seam, a stratum profiler is used to scan a coal-bearing coal stratum 2 at a uniform speed in an excavation direction of the floor roadway to investigate the general strike trend of coal seam 3. After the scan is finished, a drill is disposed in the roadway. A borescope and a gyroscope are mounted in a drill rod near a drill bit. One stratum probe borehole 4 perpendicular to the coal seam is constructed along the roadway in every 10 meters. The borehole may further be used for later-stage gas extraction. Locations of actual borehole floor coal points 5 and actual borehole roof coal end points 6 are recorded. All floor coal points and roof coal end points are respectively connected to obtain an accurate strike-trend location diagram of a coal-seam floor 7 and a coal-seam roof 8. Meanwhile, it is obtained that the actual coal-seam thickness in the designed pre-extraction area is 3.5 m and is less than the geographically explored coal-seam thickness being 4 m. In this case, the actual controlled coal reserve in the pre-extraction area has a total of 504 tons.

Figure 3:
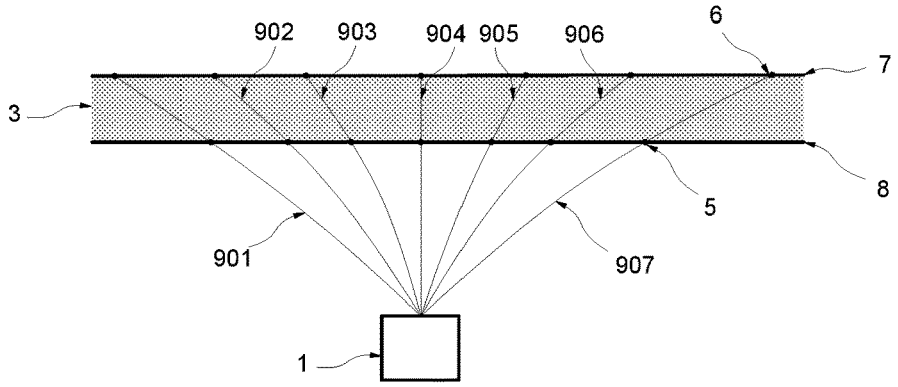
FIG. 3 is a schematic sectional view of designed and actual borehole trajectories according to some embodiments of the present invention.
Figure 4:
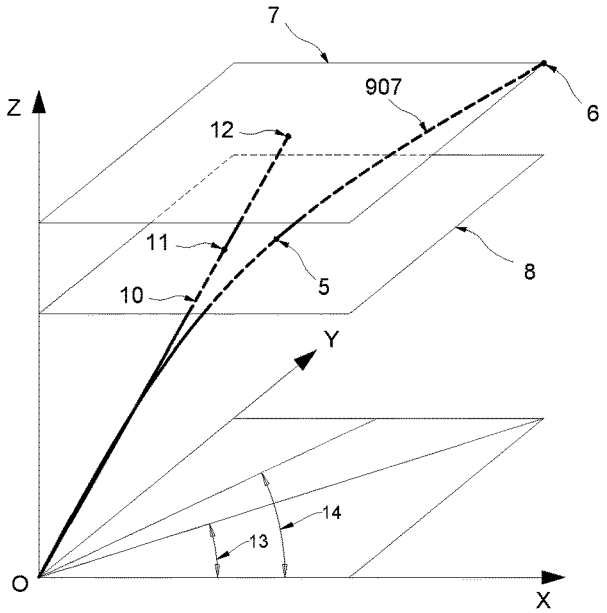
FIG. 4 is a three-dimensional schematic view of a principle of correspondence relationships between a borehole drilling azimuth angle, a borehole drilling tilt angle, and a borehole length and actual borehole coal-point coordinates, hole-bottom coordinates, and a three-dimensional borehole trajectory according to some embodiments of the present invention.
Figure 5:
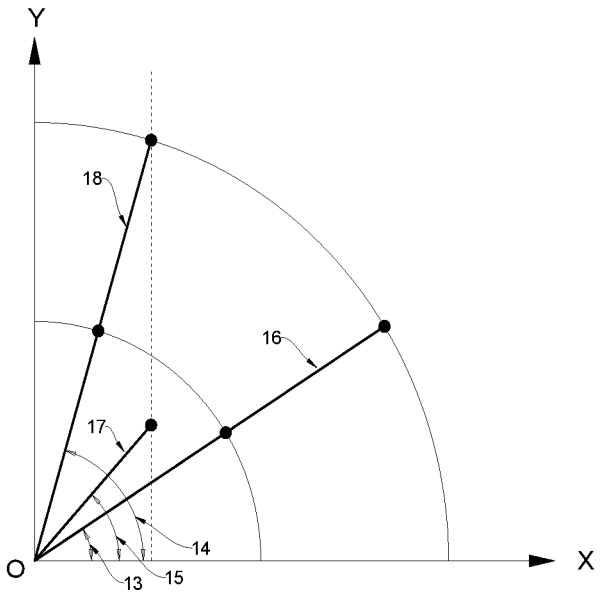
FIG. 5 is a schematic projection view of a relative relationship among a designed trajectory, an actual borehole trajectory, and a rectified borehole trajectory in a horizontal plane according to some embodiments of the present invention.

Next, a drill is disposed in the floor roadway 1. After construction is completed, a group of actual construction boreholes 901 to 907 are formed, as shown in FIG. 3. The gyroscope and the endoscopic camera are used to respectively track and record parameters of each borehole. See Table 1 for the obtained designed borehole parameters and actual completion parameters. The borehole 907 is used as an example. The orientation relationship between a designed borehole and an actual construction borehole is shown in FIG. 4.

TABLE 1

Correspondence Table Between Designed Borehole Parameters and Actual Completion Parameters

| Bore hole number | Designed azimuth angle | Designed tilt angle | Actual azimuth angle | Actual tilt angle | X coordinate of designed roof coal end point | X coordinate of actual roof coal end point | Y coordinate of designed roof coal end point | Y coordinate of actual roof coal end point | Designed hole length | Actual hole length |
|---|---|---|---|---|---|---|---|---|---|---|
| 901 | 185 | 43 | 204 | 38. | −15 | −16.3 | 1.3 | 6.6 | 20.6 | 23.2 |
| 902 | 185 | 54 | 202 | 49 | −10 | −10.8 | 0.9 | 5.0 | 17.1 | 19.5 |
| 903 | 185 | 70 | 203 | 64 | −5 | −6.1 | 0.4 | 2.7 | 14.7 | 17.3 |
| 904 | 0 | 90 | 339 | 90 | 0 | 0.0 | 0.0 | 0.0 | 13.8 | 14.8 |
| 905 | 355 | 70 | 338 | 67 | 5.0 | 5.4 | 0.4 | 2.4 | 14.7 | 17.1 |
| 906 | 355 | 54 | 335 | 49 | 10 | 11.1 | 0.9 | 4.5 | 17.1 | 19.8 |
| 907 | 355 | 42 | 336 | 35 | 15 | 18.4 | 1.3 | 7.8 | 2.0 | 25.9 |

Note:
The angle unit in the table is "°", and the unit of the coordinate and hole length is "m".

Boreholes are rectified according to the data in Table 1. The borehole 907 is used as an example. An actual borehole azimuth angle 13 is first adjusted to a rectified borehole azimuth angle 14, so that an actual trajectory obtained after azimuth angle adjustment is consistent with a horizontal coordinate X of a designed borehole 10. When only an azimuth angle is adjusted, a trajectory shape of a borehole does not change. Therefore, the length L of a rectified borehole trajectory horizontal projection 18 is the same as the length of an actual borehole trajectory horizontal projection 16. That is, an X coordinate value of an actual roof coal end point of the borehole 907 in Table 1 is 18.4 m/cos 336°=20.1 m. Therefore, the arccosine value of a ratio of an X-axis length $L_X$ of a designed borehole trajectory horizontal projection 17 to the length L of the rectified borehole trajectory horizontal projection 18 is $\arccos(L_X/L)=41.7°$. The X coordinate of the designed roof coal end point of the borehole 907 in Table 1 is 15 m. Therefore, the rectified borehole azimuth angle 14 is 360°−41.7°=318.3°.

$L_p$ of the borehole obtained after azimuth angle adjustment is then adjusted in a direction opposite to a Y-axis offset direction. $L_p$ is equal to the projection length $L_j$ of the post-azimuth-angle-rectification borehole trajectory horizontal projection 18 of the actual construction borehole 907 on the Y axis minus a projection length $L_y$ of the designed borehole 10 on the Y axis. The Y coordinate value of the designed roof coal end point of the borehole numbered 907 in Table 1 is 1.3 m, where $L_J=L\times\sin(\arccos(L_X/L))=12.2$ m. In this case, $L_p=L_j-L_y=10.9$ m, so as to obtain the designed parameters after rectification: the azimuth angle is 318.3°, the tilt angle is 42°, the X coordinate of the drilling hole is 0 m, the Y coordinate of the drilling hole is −10.9 m, and the Z coordinate of the drilling hole is 0 m.

Eventually, the rectified and reconstructed boreholes 901 to 907 are connected to a gas extraction pipeline, and an accumulated gas extraction amount per meter of each borehole in six months is measured respectively and filled in Table 2. It can be known according to an actual hole length and an actual single-meter gas drainage amount that an accumulated extraction amount of gas in six months may be 2816.8 $m^3$. In this case, in the controlled area, the gas content may be actually reduced to 5.6 $m^3/t$, and the residual gas content may be 6.4 $m^3/t$, so that requirements are satisfied.

TABLE 2

Comparison Table of Designed Borehole Extraction Flow Rate Parameters and Actual Extraction Parameters

| Borehole number | Designed hole length (meter) | Designed single-meter gas drainage amount (cubic meter/meter) | Actual hole length (meter) | Actual single-meter gas drainage amount (cubic meter/meter) |
|---|---|---|---|---|
| 901 | 5.6 | 71 | 6.7 | 73 |
| 902 | 4.7 | 71 | 5.5 | 72 |
| 903 | 4.1 | 71 | 4.5 | 70 |
| 904 | 3.8 | 71 | 3.8 | 68 |
| 005 | 4.0 | 71 | 4.3 | 71 |

TABLE 2-continued

Comparison Table of Designed Borehole Extraction Flow Rate Parameters and Actual Extraction Parameters

| Borehole number | Designed hole length (meter) | Designed single-meter gas drainage amount (cubic meter/meter) | Actual hole length (meter) | Actual single-meter gas drainage amount (cubic meter/meter) |
|---|---|---|---|---|
| 906 | 4.7 | 71 | 6.0 | 73 |
| 907 | 5.6 | 71 | 8..2. | 75 |

Boreholes are constructed in groups in a roadway direction. Each group of boreholes have the same design and construction parameters. Therefore, other groups of boreholes are constructed according to the foregoing rectified borehole design parameters, so as to achieve expected design effects of the group of boreholes, thereby improving the accuracy of design and construction.

In general, in the following claims, the terms used should not be construed to limit the claims to the specific embodiments disclosed in the specification and the claims, but should be construed to include all possible embodiments along with the full scope of equivalents to which such claims are entitled.

What is claimed is:

1. A method for precisely extracting coal-mine gas, comprising:

scanning a stratum profile of a to-be-extracted area of a coal seam;

constructing stratum probe boreholes in the area of which the stratum profile is scanned;

drawing a change trend graph of coal-seam strike, coal-seam dip, and coal-seam thickness in the to-be-extracted area;

determining, according to coal-seam parameters of the to-be-extracted area and gas extraction standard requirements, a quantity of boreholes that need to be constructed and specific borehole construction parameters;

installing a drill at a location at which construction is to be performed, and mounting a gyroscope and an endoscopic camera inside a drill bit of the drill;

performing construction in the coal seam by using the drill, tracking trajectories of a group of boreholes having the borehole construction parameters, and recording the borehole construction parameters and actual coal-point coordinates and hole-bottom coordinates;

adjusting the borehole construction parameters according to a three-dimensional orientation relationship between the borehole construction parameters and actual borehole coal-point parameters;

connecting the boreholes to an extraction pipeline, and mounting orifice meters to record gas extraction flow rates and gas extraction flow rates per meter of the different boreholes; and designing and precisely constructing, according to the adjusted borehole construction parameters and the gas extraction flow rates per meter, other boreholes to predesigned borehole locations, sealing the boreholes after construction is completed, and performing gas extraction.

2. The method for precisely extracting coal-mine gas according to claim 1, wherein scanning a stratum profile includes using a stratum profiler in a roadway excavation direction with a construction location being a coal seam floor roadway.

3. The method for precisely extracting coal-mine gas according to claim 1, wherein constructing the stratum probe boreholes includes constructing the stratum probe boreholes to penetrate a coal bearing member, until cinder is no longer discharged.

4. The method for precisely extracting coal-mine gas according to claim 1, wherein drawing the change trend graph of coal-seam strike, coal-seam dip, and coal-seam thickness in the to-be-extracted area includes using a comprehensive determination method combining scan with a stratum profiler and borehole coordinate correction, and further includes determining strike trend of a coal-bearing stratum by using the stratum profiler, and then delimiting an accurate boundary of the coal seam by using borehole coordinates.

5. The method for precisely extracting coal-mine gas according to claim 1, wherein, for actual coal-seam floor coal-point coordinates and actual coal-seam roof coal-point coordinates, the endoscopic camera is used to record trajectory points respectively corresponding to borehole floor coal points and borehole roof coal end points, and specific coordinate values are then correspondingly determined from borehole trajectory points recorded by the gyroscope.

6. The method for precisely extracting coal-mine gas according to claim 1, wherein adjusting the borehole construction parameters includes adjusting an azimuth angle, so that horizontal projections of a roof coal point of an actual borehole-trajectory and a designed roof coal point have a same length in a direction perpendicular to a roadway, and then adjusting a drilling location in a direction opposite to an offset direction according to an offset amount of a borehole in a roadway direction.

* * * * *